US009837756B2

(12) United States Patent
Toyoda

(10) Patent No.: US 9,837,756 B2
(45) Date of Patent: Dec. 5, 2017

(54) WIRE COVER AND ELECTRICAL CONNECTOR

(71) Applicant: Tyco Electronics Japan G.K, Kanagawa-ken (JP)

(72) Inventor: Keisuke Toyoda, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/568,357

(22) Filed: Dec. 12, 2014

(65) Prior Publication Data

US 2015/0171547 A1 Jun. 18, 2015

(30) Foreign Application Priority Data

Dec. 13, 2013 (JP) ..... 2013-257805

(51) Int. Cl.
*H01R 13/62* (2006.01)
*H01R 13/56* (2006.01)
*H01R 13/629* (2006.01)

(52) U.S. Cl.
CPC ..... *H01R 13/567* (2013.01); *H01R 13/62933* (2013.01)

(58) Field of Classification Search
CPC ..... H01R 13/62938; H01R 13/633
USPC ..... 439/157, 160, 152, 153, 155, 159, 372, 439/341
See application file for complete search history.

(56) References Cited

U.S. PATENT DOCUMENTS 7,537,478 B2 * 5/2009 Foltz ..... H02G 3/0487 439/466
8,439,695 B2 5/2013 Komiyama
8,480,417 B2 7/2013 Suemitsu et al.
2011/0237109 A1 * 9/2011 Komiyama ..... H01R 13/62944 439/345

FOREIGN PATENT DOCUMENTS

JP 2009140808 A 6/2009

OTHER PUBLICATIONS

Japanese Office Action, dated May 12, 2017, 3 pages.

* cited by examiner

*Primary Examiner* — Phuong Chi T Nguyen
(74) *Attorney, Agent, or Firm* — Barley Snyder

(57) ABSTRACT

A wire cover of an electrical connector is provided and includes a main body and a hood. The main body includes a wire receiving section extending therein. The hood projects from a side of the main body. The hood includes a first wire receiving section disposed along a side of the hood and extending transversely with respect to the main body and a reinforcing rib provided on an opposite side wall of the hood.

18 Claims, 5 Drawing Sheets

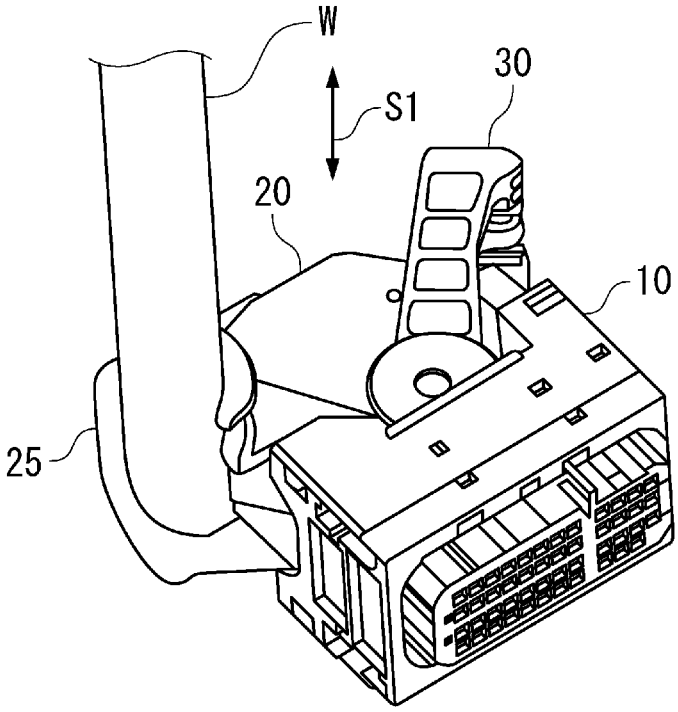
Fig. 4a
Fig. 4b
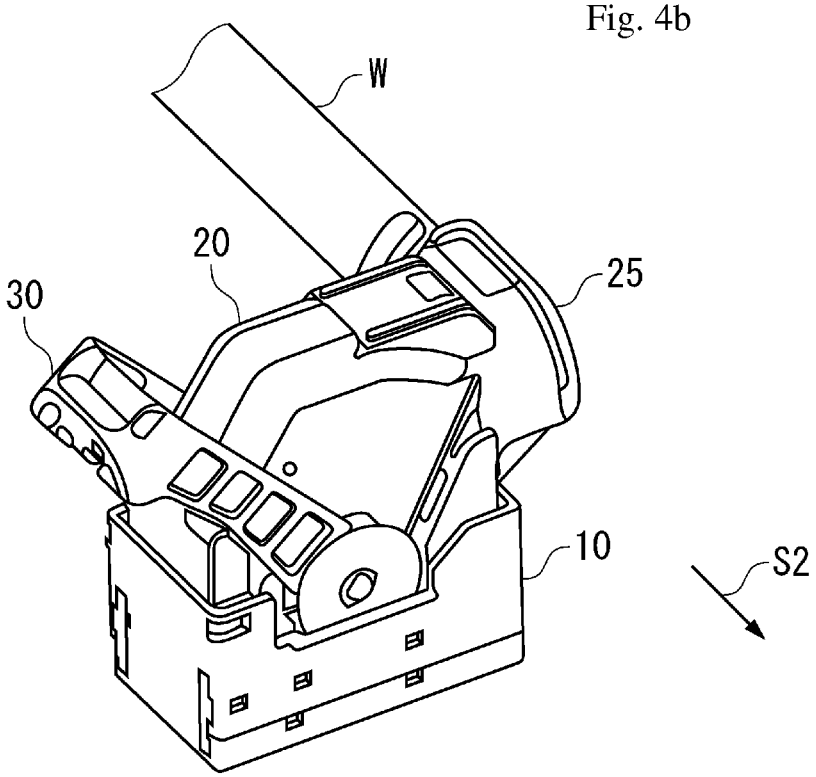

WIRE COVER AND ELECTRICAL CONNECTOR

CROSS-REFERENCE TO RELATED APPLICATIONS

This application claims the benefit of the filing date under 35 U.S.C. §119(a)-(d) of Japanese Patent Application No. 2013-257805, filed Dec. 13, 2013.

FIELD OF THE INVENTION

The invention relates to a wire cover and, more particularly, a wire cover for an electrical connector.

BACKGROUND

In recent years, electrical connectors used in the field of automobiles or the like have progressed. In some known electrical connector, multiple electrical wires are provided and led out a housing of the electrical connector to the number of positions.

Japanese Patent Application JP 2012-33289 A discloses a known wire cover covering multiple electrical wires. JP 2012-33289 suggests that this known wire cover prevents deformation or breakage of a hood portion. That is, during assembly, with the electrical connector connected to a control unit, an operator holds the electrical wires by his/her hand and routes them in order to set the electrical wires in place. JP 2012-33289 A discusses the problem that, during routing, the hood portion receives a large force via the electrical wires, which can cause deformation or breakage of the hood portion.

Like the wire cover in JP 2012-33289 A, some wire covers have an electrical wire receiving section formed transversely with respect to a main body of the wire cover so as to be adapted to the case where the electric wire is led out transversely with respect to the electrical connector. When an operator holds the electrical wires by his/her hand to route them regarding the electrical connector equipped with this wire cover, while a side wall of the hood opposite to the transverse leading-out side (hereinafter, simply referred to as side face wall) may collide with peripheral members and the side face wall may be broken. In particular, Japanese Patent Application no. JP 2011-204494 A discloses a known hood having an exposed side face wall, such as a lever-type electrical connector, which has a high risk of breakage.

SUMMARY

The present invention has been made in order to solve such problems, and an object of the invention, among others, is to provide a wire cover for an electrical connector. The wire cover includes a main body and a hood. The main body includes a wire receiving section extending therein. The hood projects from a side of the main body. The hood includes a first wire receiving section disposed along a side of the hood and extending transversely with respect to the main body and a reinforcing rib provided on an opposite side wall of the hood.

BRIEF DESCRIPTION OF THE DRAWINGS

The invention will now be described by way of example, with reference to the accompanying Figures, of which:

FIG. 4A is a bottom perspective views of a lever-type connector according to the invention with an electrical wire led out therefrom;

FIG. 4B is a top perspective views of the lever-type connector of FIG. 4A.

DETAILED DESCRIPTION OF THE EMBODIMENT(S)

The present invention is described in detail below on the basis of an embodiment illustrated in the accompanying drawings.

Figure 1:
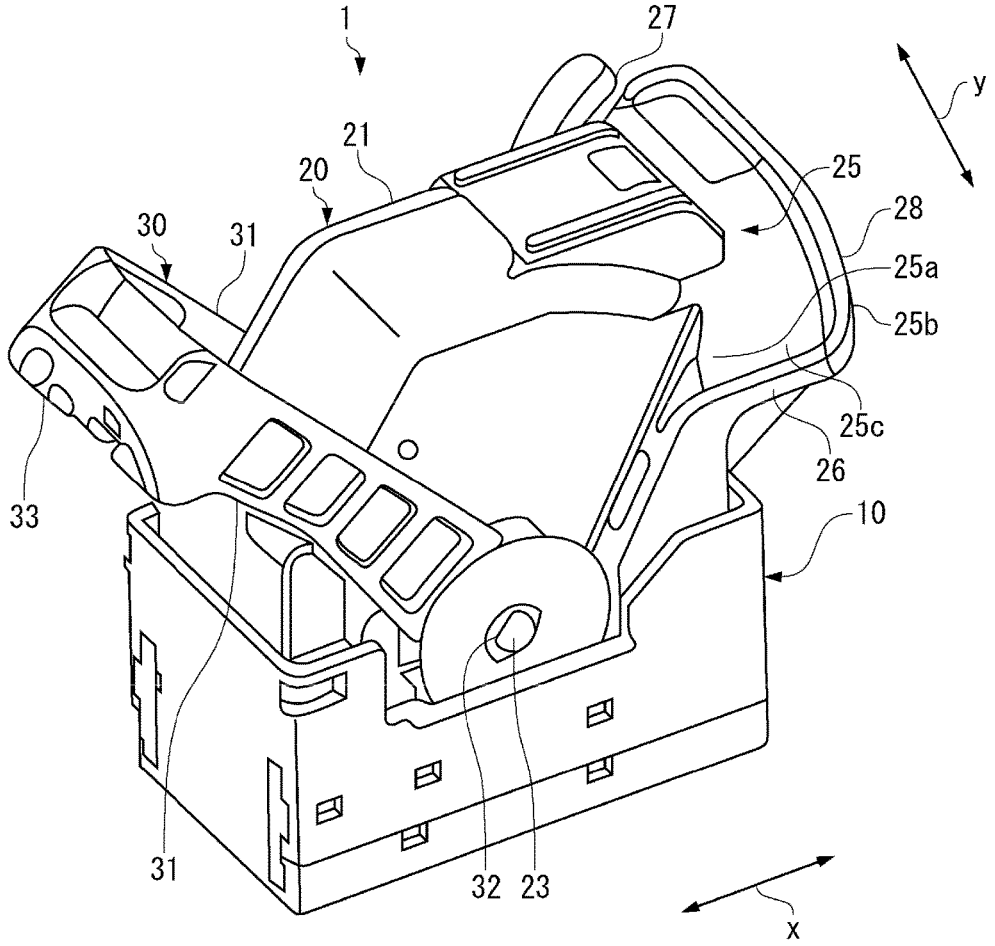
FIG. 1 is a top perspective view of a lever-type connector according to the invention.
Figure 2:
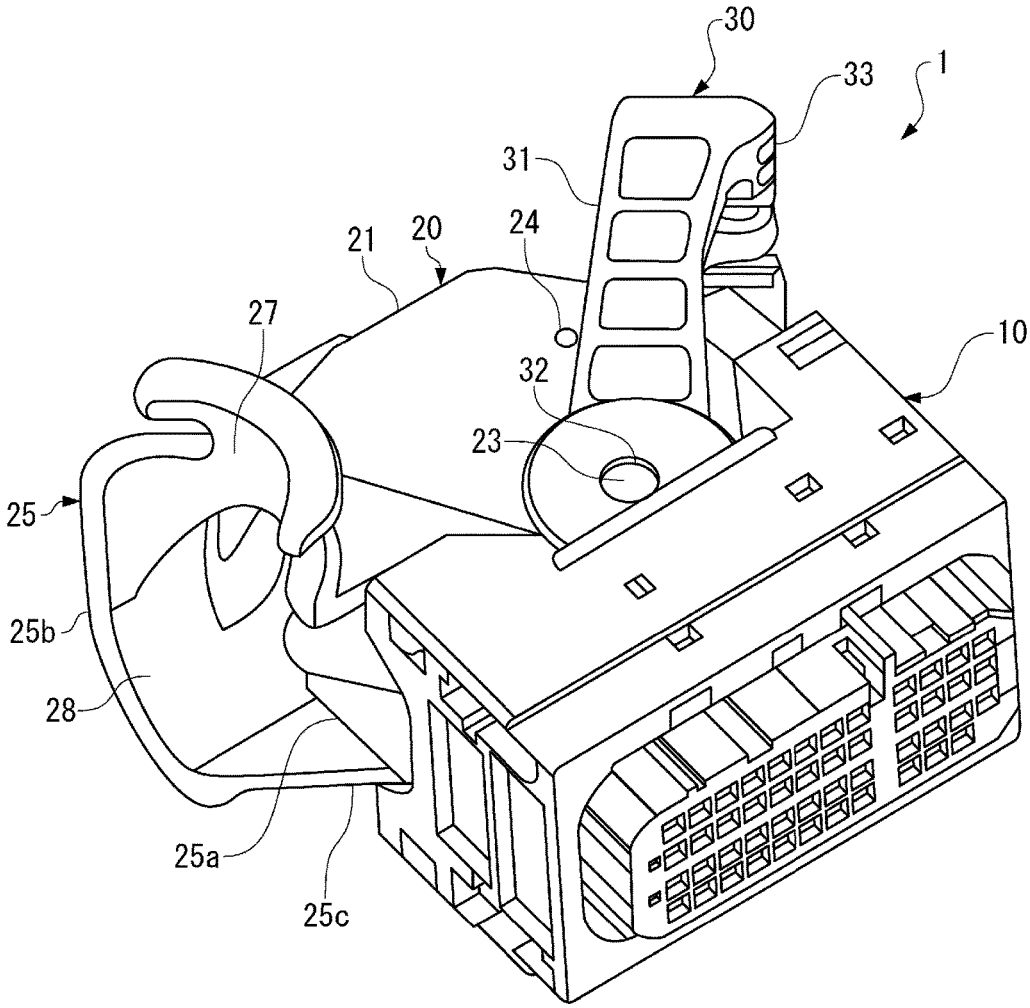
FIG. 2 is a bottom perspective view of the lever-type connector of FIG. 1.

As shown in FIGS. 1 and 2, a lever-type connector 1 according to the invention is provided with a housing 10 for a plurality of terminals (not shown), a wire cover 20 attached to the housing 10, and a lever 30 attached to the wire cover 20. The lever-type connector 1 is configured to mate with a mating connector by utilizing a lever mechanism driven by the action of the lever 30.

The housing 10 is provided with, in addition to a plurality of housing elements, a retainer securing the terminals, a seal member, a slider driven by the lever to mate with the mating connector, and the like. These members and the actions thereof are disclosed in JP 2011-204494 A, for example. Therefore, the description of the housing 10 is omitted as much as possible, for the sake of brevity, and the following description focuses on the wire cover 20 that is a characteristic part of this embodiment.

The wire cover 20 formed by injection molding of insulating resin is attached to a rear side of the housing 10, and covers and protects a bundle of electrical wires led out rearward from the terminals accommodated in the housing 10.

The wire cover 20 has a main body 21 covering and receiving therein electrical wires (not shown) connected to the terminals held by the housing 10. This main body 21 is closed except for a side facing the housing 10 and a region from which the electrical wires are led out.

Figure 3A:
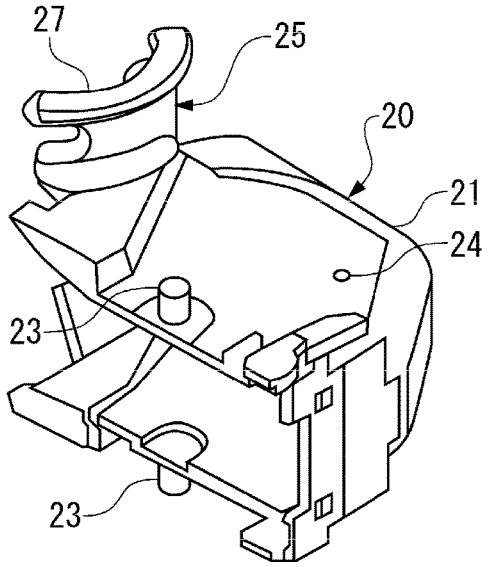
FIG. 3A is a front, bottom, left perspective view of a wire cover of the lever-type connector of FIG. 1.
Figure 3B:
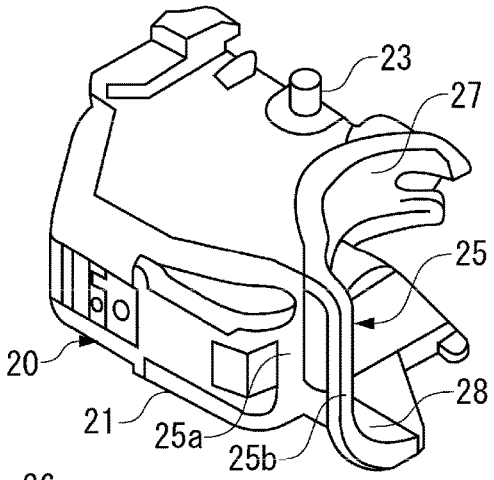
FIG. 3B is a rear, top, left perspective view of the wire cover of the lever-type connector of FIG. 1.

As shown in FIGS. 1 to 3, supporting shafts 23, 23 are provided on both side faces of the main body 21. The lever 30 is pivotally mounted to the supporting shafts 23, 23. The lever 30 is provided with a pair of arms 31, 31 having supporting holes 32, 32 at one end, respectively, into which the supporting shafts 23, 23 are inserted, respectively, and a joining beam 33 joining the other ends of the arms 31, 31 together. The wire cover 20 rotatably supports the lever 30 using the supporting shafts 23, 23.

As shown in FIGS. 1 to 3, a lock 24 catching the lever 30 set in a standby position so that the lever 30 does not accidentally rotates is provided on a side face of the main body 21. The lock 24 and the arm 31 of the lever 30 set in a mating start position are caught by each other so that the lever 30 is locked.

To mate the lever-type connector 1 with the mating connector, the lever 30 is rotated from the standby position shown in FIGS. 1 to 3 to a mating completion position on the side where a hood 25 is provided.

The hood 25 projecting from an electrical wire leading-out side of the main body 21 is formed integrally with the main body 21.

This hood 25 is provided with a first wire receiving section 27 directing the electrical wires transversely out of the hood. The hood 25 is also provided with a second wire receiving section 28 at a distal end thereof, so that in addition to a use form in which the electrical wire is transversely led out through the first wire receiving section 27, the electrical wires can also be led out straight through the second wire receiving section 28. When the electrical wires are led out transversely, the electrical wires are fixed by tying the hood 25 around the first wire receiving section 27 and the electrical wires together with a tying band, for example. Similarly, when the electrical wire is led out straight, the electrical wires are fixed by tying the hood 25 around the second wire receiving section 28 and the electrical wires together with a tying band, for example.

In the shown embodiment, the hood 25 is circular when viewed in cross-section. The hood 25 projects from a base 25*a*, which is connected to the main body 21 toward a distal end 25*b* distant from the main body 21.

Figure 3C:
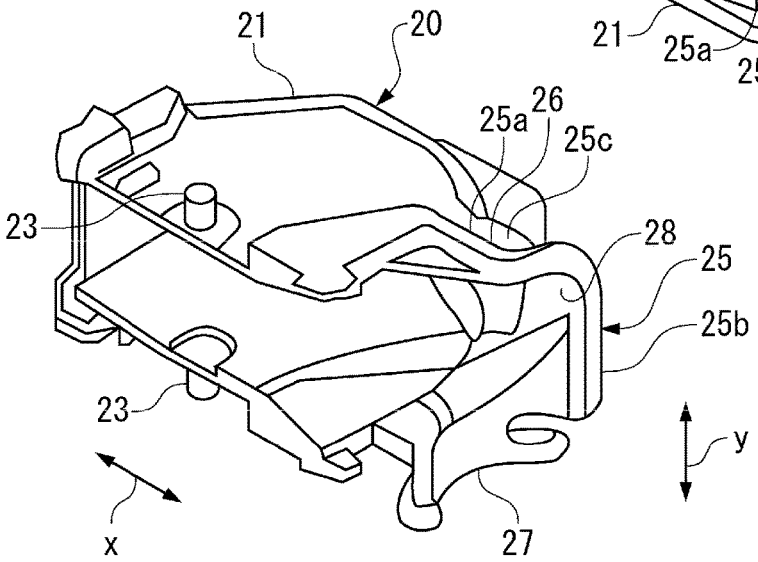
FIG. 3C is a rear, bottom, right perspective view of the wire of the lever-type connector of FIG. 1.

The hood 25 is provided with a reinforcing rib 26 on a side face wall 25*c* opposite to the first wire receiving section 27 side, as shown in FIGS. 1 and 3C. The reinforcing rib 26 is formed on an outer periphery of the side face wall 25*c* along a front-back direction x. The reason for providing the reinforcing rib 26 will be explained with reference to FIG. 4. In FIG. 4, however, the reinforcing rib 26 is not shown.

In actual mating operation, an operator holds and routes the electrical wires W led out of the lever-type connector 1. At this time, there is a risk that the lever-type connector 1 may collide with the surroundings. Considering the possibility of collision of the wire cover 20, a side S1 from which the electrical wires W are led out and which is shown in FIG. 4A generally faces the operator, and therefore may hardly collide with the surroundings. On the other hand, a side S2 opposite to the electrical wire W leading-outside shown in FIG. 4B faces outward from the operator, and therefore tends to collide with the surroundings. In particular, a result of simulation of the operator's action also showed that the hood 25 projecting rearward tended to collide with the surroundings, and it was confirmed that the hood 25 might be broken depending on the degree of collision.

Therefore, the lever-type connector 1 of the shown embodiment is provided with the reinforcing rib 26 in order to prevent the hood 25 from being broken.

The reinforcing rib 26 can be provided on an inner peripheral face of the hood 25, but, in that case, the reinforcing rib 26 may become an obstacle to route the electrical wires W disposed in the hood 25, so the reinforcing rib 26 is provided on an outer peripheral face of the side face wall 25*c* of the hood 25, as shown in FIGS. 1 and 3C.

Further, the reinforcing rib 26 is provided over an entire area from the base 25*a* of the hood 25 to the distal end 25*b* thereof. Moreover, the reinforcing rib 26 is provided so as to project beyond the side face wall 25*c* excluding the reinforcing rib 26. Therefore, it is highly probable that the thick reinforcing rib 26 collides with the surroundings when the side face wall 25*c* side collides with the surroundings while the lever-type connector 1 is being routed with the electrical wires W in hand. For this reason, it is highly unlikely that the hood 25 may be broken.

Figure 5:
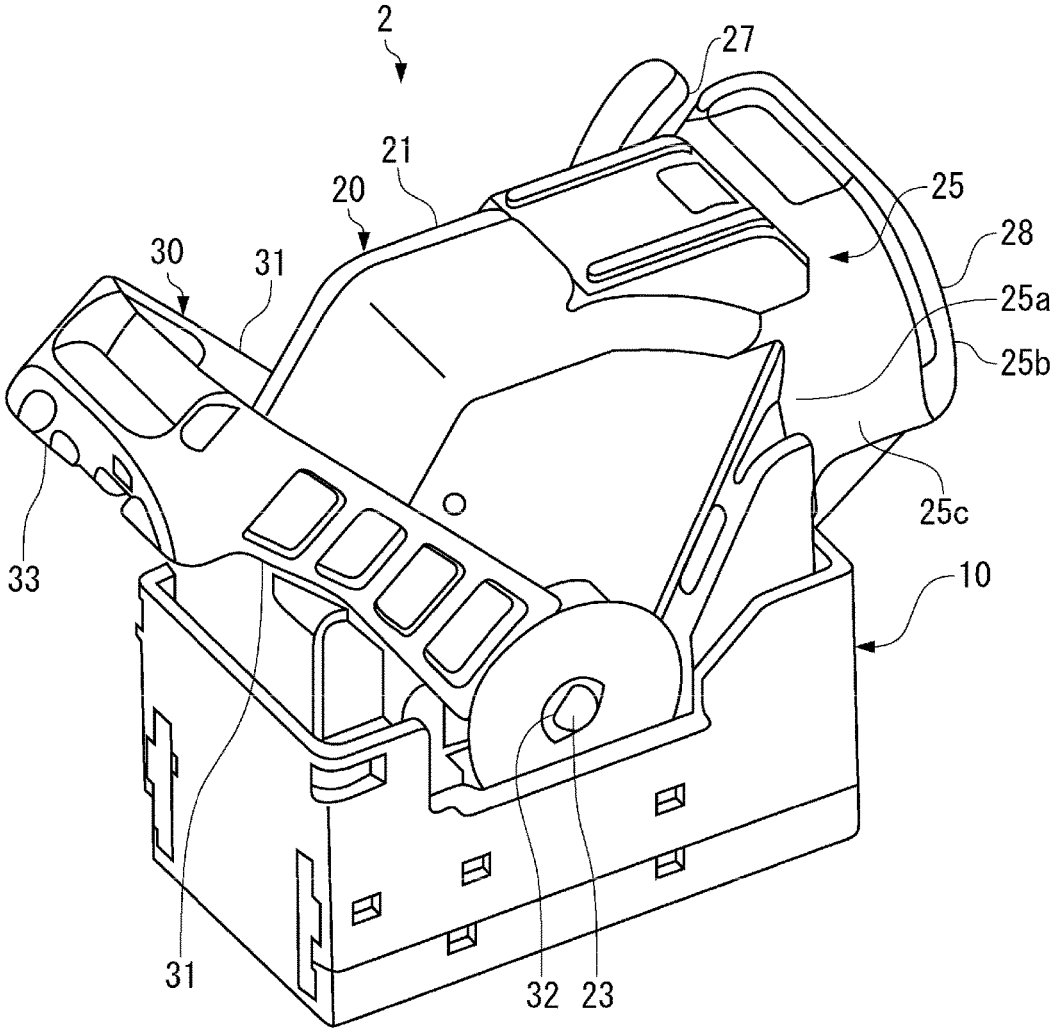
FIG. 5 is another perspective view of a lever-type connector.

Stress analysis has been performed for the lever-type connector 1 of the embodiment shown in FIGS. 1 to 3 and a lever-type connector 2 (see FIG. 5) having the same design as the lever-type connector 1, except that the lever-type connector 2 was not provided with the reinforcing rib 26. This analysis has been performed by calculating reaction force obtained when the same amount of displacement was given to the side of the hood 25 opposite to the electrical wires W leading-out side in a direction indicated by arrow from the outside toward the inside. As a result, it has been confirmed that the lever-type connector 1 provided with the reinforcing rib 26 has approximately 1.5 times as high reaction force as the lever-type connector 2 which is not provided with the reinforcing rib 26, and is harder to break.

In addition, since the lever-type connector 1 is provided with the reinforcing rib 26, the hood 25 can also be prevented from being broken when the electrical wires are led out straight. That is, in the case of leading out the electrical wires straight, when the lever-type connector 1 is routed, the electrical wires can be swung in a transverse direction y (FIGS. 1 and 3C) intersecting the leading-out direction, namely, transversely. Then, the hood 25 tied together with the electrical wires is subjected to force in the transverse direction y, but, since the reinforcing rib 26 is provided, the reinforcing rib 26 receives the force in the transverse direction y to prevent the hood 25 from being broken.

As described above, since the rib is provided in a predetermined region, the risk of breakage of the hood due to collision can be reduced significantly even in the wire cover 20 from which the electrical wire is led out transversely and which exposes the side face wall 25*c* of the hood on the opposite side to the wire leading-out side. Further, when this wire cover 20 is used to leading-out the electrical wires straight, the side face wall 25*c* can be prevented from being broken even when the electrical wires are swung.

An embodiment of the invention has been described above, but the components listed in the aforementioned embodiment can be selectively removed or, if necessary, replaced with another component without departing from the gist of the present invention.

The reinforcing rib 26 takes a strip-like shape, but the width and projection height from the hood thereof may be appropriately determined according to required strength. For example, the width and height thereof are not limited to a certain width and height, but the width can be narrowed from the base 25*a* toward the distal end 25*b*, and the height can be lowered from the base 25*a* toward the distal end 25*b*.

Further, although the reinforcing rib 26 is formed so as to be parallel to the front-back direction x, the reinforcing rib 26 is only required to be formed from the base 25*a* to the distal end 25*b*, and can be provided so as to be oblique to the front-back direction x.

Further, the invention may be applicable to any lever-type connector. That is, the lever-type connector to which the invention is applied is not limited to a type that mates with the mating connector by means of a slider provided with a cam mechanism shown herein, but also applicable to a lever-type connector of a type in which a lever is provided with a cam mechanism. In addition, the lever is not limited to a type that is pivotally mounted on the wire cover, but is also applicable to a lever-type connector of a type that is pivotally mounted on the housing.

What is claimed is:

1. A wire cover of an electrical connector comprising:

a main body having a wire receiving section extending therein;

a pair of supporting shafts, each supporting shaft disposed on an opposite side face of the main body; and a hood connected to the main body at a base of the hood and projecting from a side of the main body to a distal end, a first wire receiving section disposed along a side of the hood and extending transversely with respect to the main body, and a reinforcing rib provided on an opposite side wall of the hood extending from the base to the distal end.

2. The wire cover according to claim 1, wherein the hood further includes a second wire receiving section positioned adjacent the first wire receiving section.

3. The wire cover according to claim 2, wherein the second wire receiving section extends substantially perpendicular with respect to the first wire receiving section.

4. The wire cover according to claim 1, further comprising a lever pivotally mounted to the pair of supporting shafts.

5. The wire cover according to claim 4, further comprising a lock disposed on the main body, the lock catching the lever.

6. The wire cover according to claim 1, wherein the reinforcing rib is a strip like projection.

7. The wire cover according to claim 6, wherein the reinforcing rib extends parallel to a length of the main body.

8. The wire cover according to claim 7, wherein the hood further includes a second wire receiving section positioned adjacent the first wire receiving section.

9. The wire cover according to claim 8, wherein the second wire receiving section extends substantially perpendicular with respect to the first wire receiving section.

10. An electrical connector comprising:

a housing holding a plurality of terminals; and a wire cover attached to the housing and having:

a main body having a wire receiving section extending therein;

a pair of supporting shafts, each supporting shaft disposed on an opposite side face of the main body; and a hood connected to the main body at a base of the hood and projecting from a side of the main body to a distal end, a first wire receiving section disposed along a side of the hood and extending transversely with respect to the main body, and a reinforcing rib provided on an opposite side wall of the hood extending from the base to the distal end.

11. The electrical connector according to claim 10, wherein the hood further includes a second wire receiving section positioned adjacent the first wire receiving section.

12. The electrical connector according to claim 11, wherein the second wire receiving section extends substantially perpendicular with respect to the first wire receiving section.

13. The electrical connector according to claim 10, further comprising a lever pivotally mounted to the pair of supporting shafts.

14. The electrical connector according to claim 13, further comprising a lock disposed on the main body, the lock catching the lever.

15. The electrical connector according to claim 10, wherein the reinforcing rib is a strip like projection.

16. The electrical connector according to claim 15, wherein the reinforcing rib extends parallel to a length of the main body.

17. The electrical connector according to claim 16, wherein the hood further includes a second wire receiving section positioned adjacent the first wire receiving section.

18. The electrical connector according to claim 17, wherein the second wire receiving section extends substantially perpendicular with respect to the first wire receiving section.

* * * * *